United States Patent [19]

Zimmerman, Jr. et al.

[11] 4,403,821

[45] Sep. 13, 1983

[54] WIRING LINE TAP

[75] Inventors: John A. Zimmerman, Jr., Hershey; William B. Long, Camp Hill, both of Pa.

[73] Assignee: AMP Incorporated, Harrisburg, Pa.

[21] Appl. No.: 240,523

[22] Filed: Mar. 4, 1981

Related U.S. Application Data

[63] Continuation of Ser. No. 17,632, Mar. 5, 1979, abandoned.

[51] Int. Cl.[3] ..... H01R 25/06

[52] U.S. Cl. ..... 339/97 P; 339/49 R; 339/107

[58] Field of Search ..... 339/97 R, 97 P, 98, 339/99 R, 47 R, 49 R, 107, 105, 258 R

[56] References Cited

U.S. PATENT DOCUMENTS

| | | | |
|---|---|---|---|
| D. 195,171 | 5/1963 | Keller | D26/1 |
| 2,744,244 | 5/1956 | Schumacher et al. | 339/47 R |
| 2,930,021 | 3/1960 | Hasselhorn | 339/99 R |
| 3,337,836 | 8/1967 | Churla | 339/49 |
| 3,654,586 | 4/1972 | Winkler | 339/49 R |
| 3,723,948 | 3/1973 | Wyatt et al. | 339/99 R |
| 3,794,957 | 2/1974 | Winkler | 339/49 R |
| 3,829,819 | 8/1974 | Eckart | 339/44 R |
| 3,874,762 | 4/1975 | Shott et al. | 339/99 R X |
| 3,935,637 | 2/1976 | Bunnell | 339/99 R X |
| 4,023,883 | 5/1977 | Raposa et al. | 339/98 |
| 4,066,316 | 1/1978 | Rollings | 339/97 R X |
| 4,109,991 | 8/1978 | Evans | 339/99 R |
| 4,153,326 | 5/1979 | Frantz | 339/99 R |
| 4,160,573 | 7/1979 | Weisenburger | 339/99 R |
| 4,168,874 | 9/1979 | Weidler | 339/99 R X |

FOREIGN PATENT DOCUMENTS

| | | | |
|---|---|---|---|
| 1007316 | 3/1977 | Canada | 339/97 P |

*Primary Examiner*—John McQuade
*Assistant Examiner*—John S. Brown
*Attorney, Agent, or Firm*—Adrian J. LaRue; Russell J. Egan

[57] ABSTRACT

A device is disclosed for effecting a line tap for modular unit, residence, or similar wiring situations. The device allows for a power cable to be tapped without utilizing a junction box, which would necessarily require severing and rejoining of the cable. The device further provides for the tapping cable to be connected to the subject power cable tap by means of known electrical connector.

8 Claims, 6 Drawing Figures

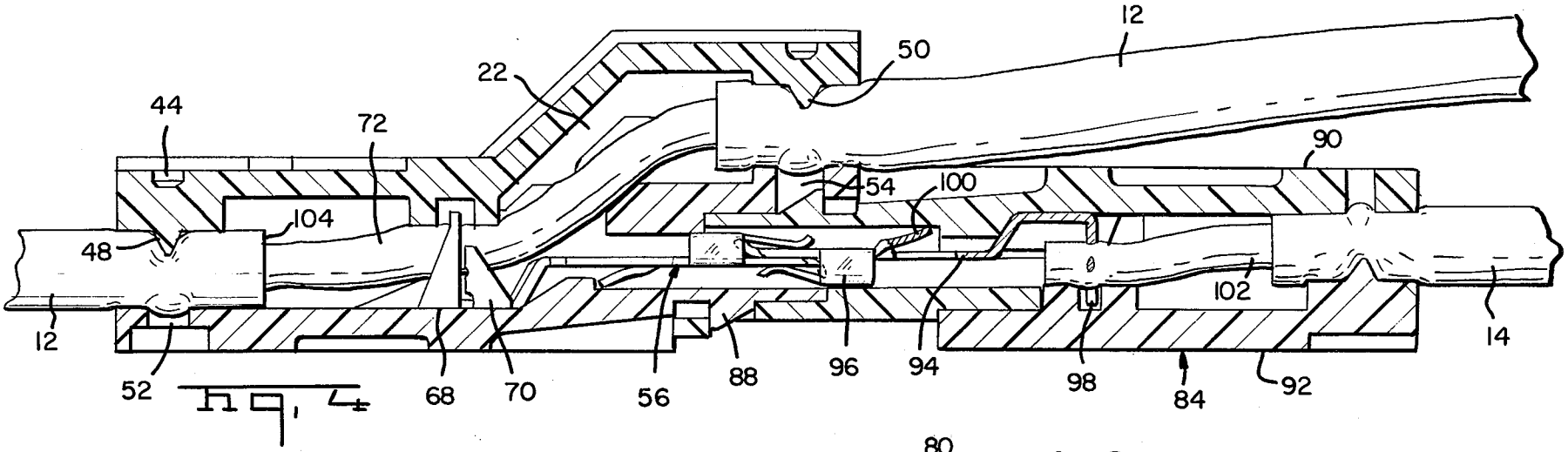
Fig. 4
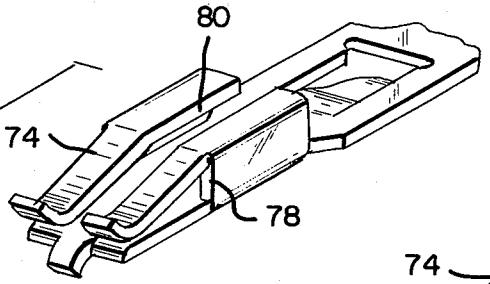
Fig. 5
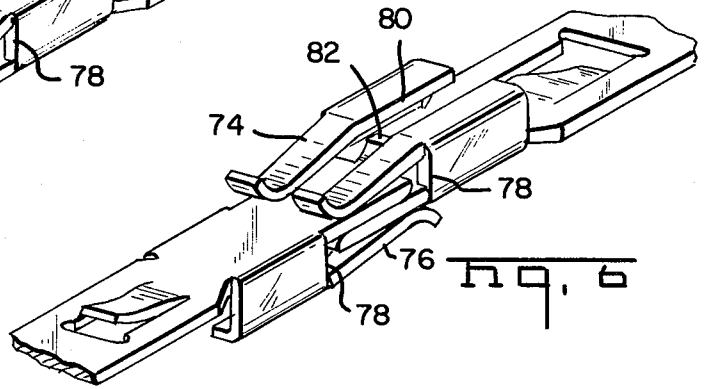
Fig. 6
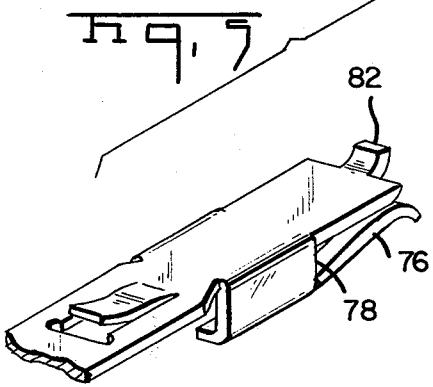

WIRING LINE TAP

This is a continuation of application Ser. No. 17,632, filed Mar. 5, 1979, now abandoned.

BACKGROUND OF THE INVENTION

1. The Field of the Invention

The present invention relates to modular unit, residence, or similar wiring and in particular to a device which is attached to a primary power cable and receives therein a secondary cable terminated by a known connector and forming a branch circuit.

2. The Prior Art

There are often times in modular unit, residence and similar wiring situations when it is desirable to create a tap off a cable run and/or form a branch circuit off of an existing line. In the past this has required installation of a junction box and the power cable to be severed, in order to be inserted into the box, and stripped to expose the conductors. The tapping line likewise had to be cut and stripped and the conductors appropriately electrically and mechanically joined to the conductors of the primary line by any of the well known methods, such as with wire nuts or soldering. This clearly is an expensive proposition in that it is both time consuming and requires a lot of additional material. Further, the prior art method of making such a tap results in a rather bulky structure at the site of the tap. The present invention overcomes the difficulties of the prior art by providing a tap which will accept a known connector of the type described in U.S. Pat. No. 4,153,326 and yet does not require either a junction box or the many steps of effecting a tap as noted above.

SUMMARY OF THE INVENTION

The subject cable tap device allows use of a known connector on a secondary or branch circuit cable to effect a tap of a primary cable run. The tap device comprises a housing adapted to receive the primary cable therein, a plurality of terminals mounted in the housing, each terminal having an insulation displacement portion on one end adapted to make connection with the conductors of the primary cable and a mating portion on the opposite end adapted to make contact with a respective terminal in a known connector which terminates the secondary or branch cable. The housing further includes means for fixedly securing the housing to a rigid member.

It is therefore an object of the present invention to produce a tap off a cable run which does not require the severing of the cable or the installation of a junction box.

It is another object of the present invention to produce a device for tapping a secondary circuit off of a primary circuit which can be used with original wiring or as additional wiring in recreation vehicles, mobile homes, manufactured housing, office partitions, modules and the like.

It is yet another object of the present invention to produce a primary power line tap which will receive a known connector used to terminate the secondary or branch circuit cable.

It is a further object of the present invention to produce a device to tap a primary circuit in a basic wiring scheme as well as form an addition to or expansion of an existing scheme.

It is still a further object of the present invention to produce a device for effecting tap of a primary cable run which device can be readily and economically produced.

The means for accomplishing the foregoing objects and other advantages of the present invention will become apparent to those skilled in the art from the following detailed description taken with reference to the accompanying drawings.

BRIEF DESCRIPTION OF THE DRAWINGS

FIG. 3 is a perspective view showing only the cables and the terminals as they are used to effect a line tap according to the present invention;

FIG. 4 is a section view, similar to FIG. 2, showing the subject line tap device engaging a primary cable and mating with secondary cable forming a branch circuit;

FIG. 5 is an exploded perspective view of the mating portions of two terminals of the present invention; and FIG. 6 is a perspective view, similar to FIG. 5, showing the terminals in a mated condition.

DETAILED DESCRIPTION OF THE PREFERRED EMBODIMENT

Figure 1:
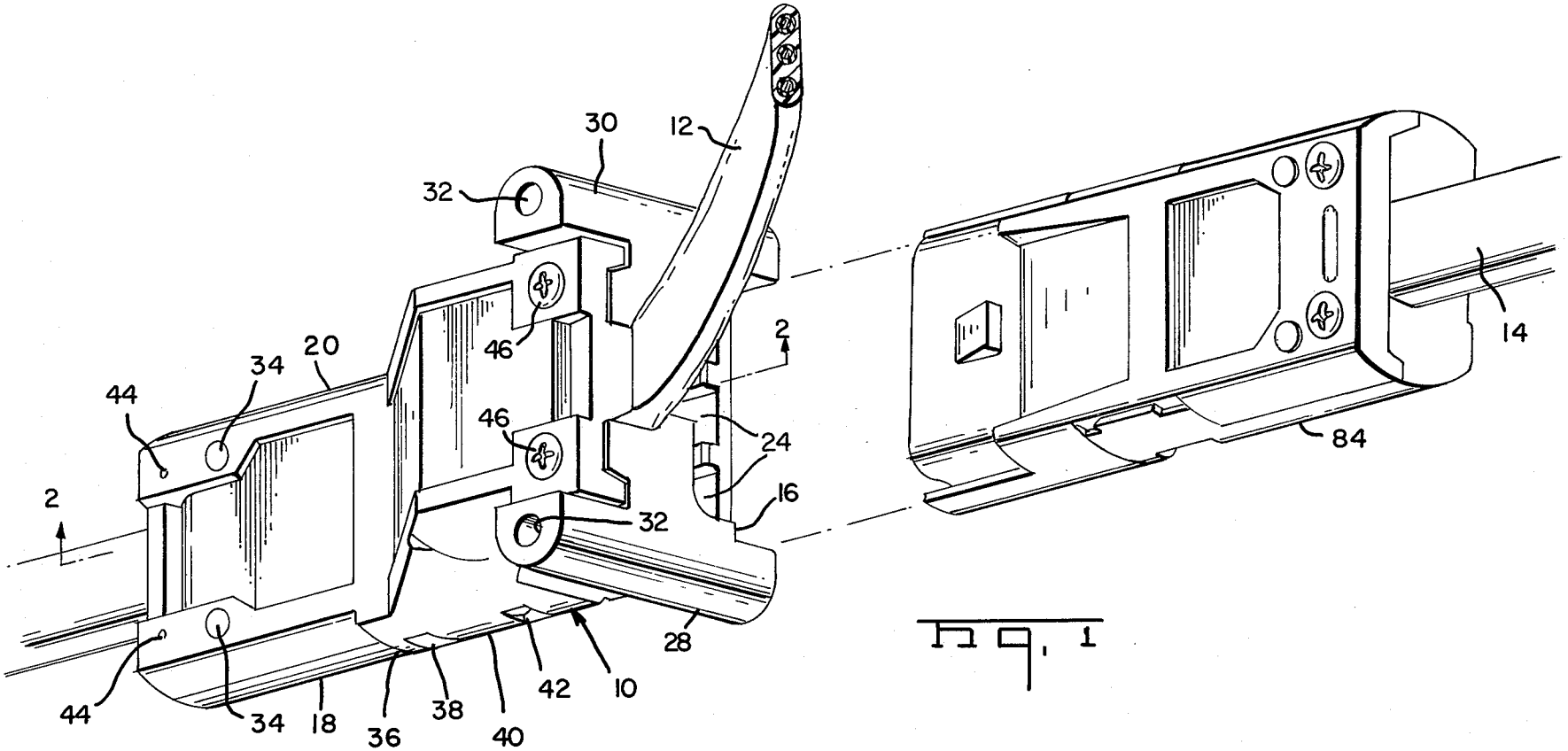
FIG. 1 is a perspective view of the subject line tap device with a mating connector exploded therefrom.
Figure 1:
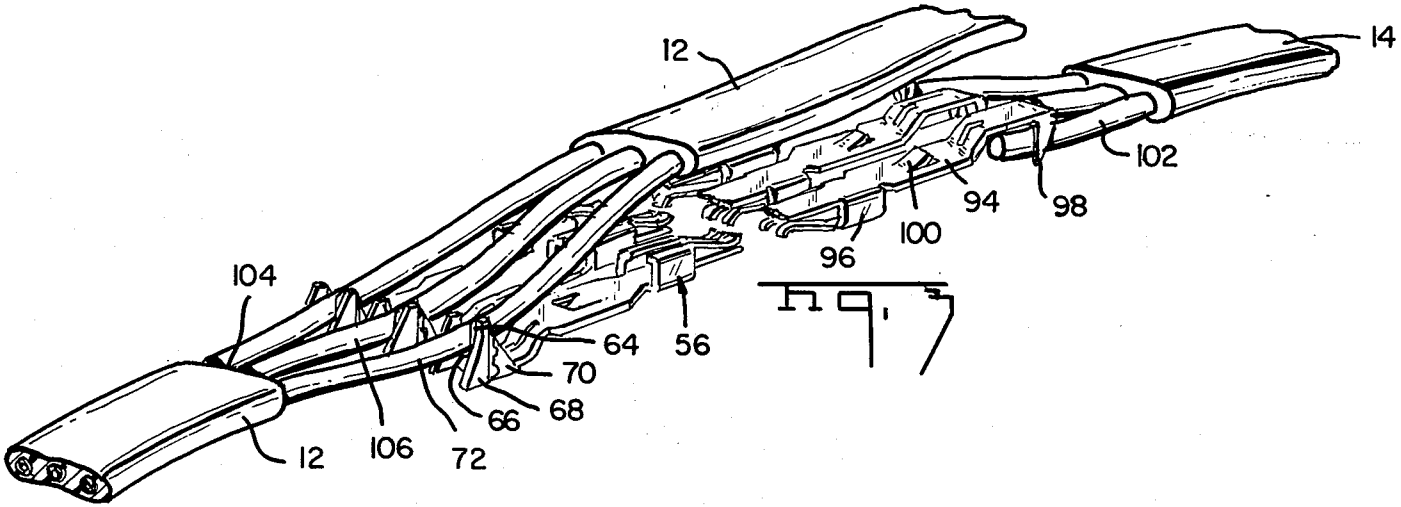
Figure 2:
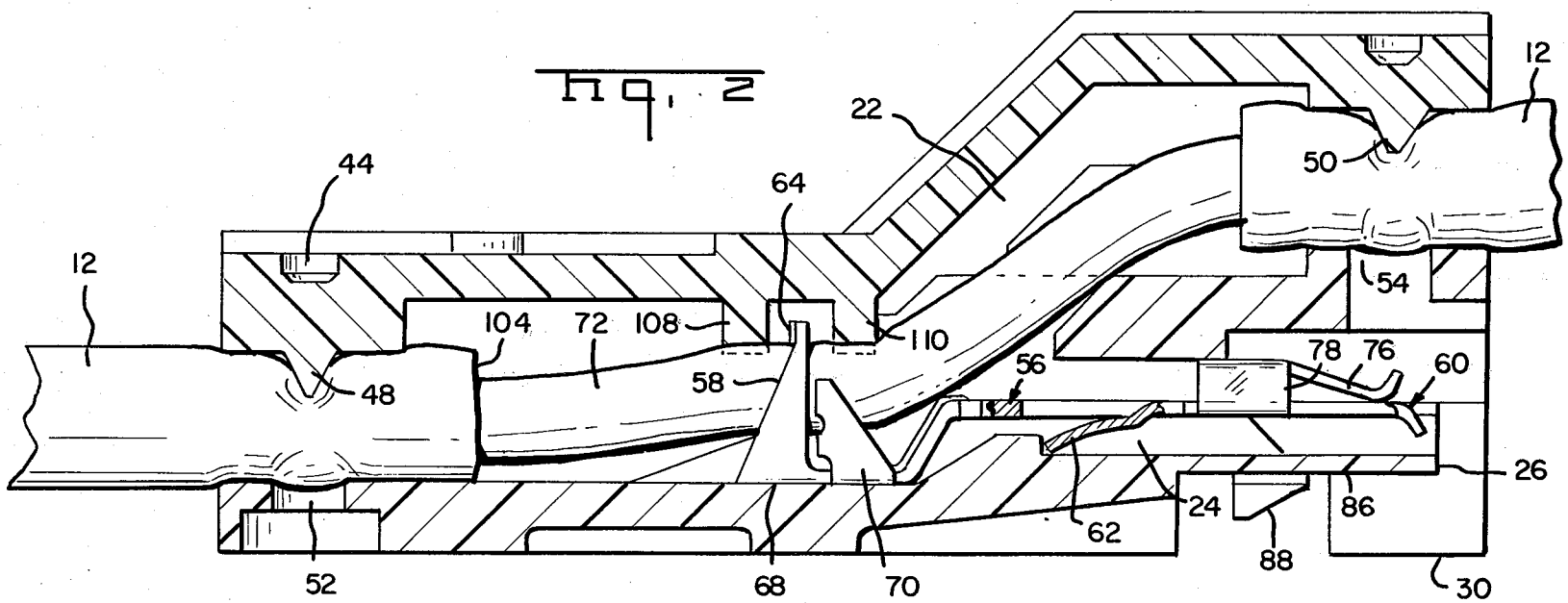
FIG. 2 is a vertical longitudinal section through the subject line tap device taken along line 2—2 of FIG. 1.

The present invention concerns a cable run tap device 10 for effecting a tap off of a primary cable 12 to connect a secondary cable 14 thereto. The tap device 10 has a two part housing 16 formed of rigid insulative material. The housing 16 includes a base member 18 and a cover member 20. Together the housing members define a through passage 22 for primary cable 12. At least two terminal passages 24 are located in the base member 18 (see FIG. 1); each of passages 24 has one end intersecting the cable passage 22 and the other end forming a mating connector face 26 (see FIG. 2). The base member 18 includes integral mounting flanges 28, 30 each of which is provided with a through bore 32, through which a nail or the like (not shown) is driven to securely mount the device 10 to a stud or the like (also not shown). Additional bores 34 are provided in the cover and base spaced from the flanges and serving a similar function. The base member 18 also includes a recess 36 in each longitudinal side wall thereof with at least one latching lug 38 projecting outwardly from the recess.

The cover member 20 includes two spaced, depending side wall latching portions 40 each having at least one aperture 42 therein aligned to receive a respective lug 38. The cover also has bores 44 located on both sides at each end for receiving screws 46 or other like members to both join the cover to the base as well as provide the necessary compression to effect a strain relief for the primary cable 12. The strain relief function is provided at both ends of the tap device 10 by inwardly directed projections 48, 50 on the cover member 20 aligned with respective recesses 52, 54 in the base member 18. The cover member also includes two inwardly directed, integral, spaced projections 108, 110 aligned with conductor engaging portions of the respective terminals.

At least two, but usually three, terminals 56 are each mounted in a respective terminal passage 24 of the base member 18. Each terminal 56 includes a conductor engaging portion 58 at one end, a mating connector engaging portion 60 at the opposite end and a locking lance 62 intermediate the ends. The conductor engaging portion 58 preferably is of the insulation piercing type and includes an upstanding plate like portion 64 having a centrally disposed slot 66 formed therein and front and rear tabs 68, 70, respectively providing support for the plate 64 during insertion into the slot of the conductor 72 of the primary cable 12. The mating portion 60 of the terminal can have any suitable configuration and has been shown with a first blade portion 74 and a second overlying blade portion 76. The second blade portion is preferably formed by two segments each connected to a respective margin of the first blade portion along bights 78 to define a central slot 80. The first blade portion 74 has a tine 82 formed on the free end thereof for engaging in slot 80.

The mating face 26 of the base member 18 is profiled to engage a mating connector 84. The mating face 26 is simply shown as having a polarizing wall 86 and a latching lug 88.

The mating connector 84 illustrated is similar to that shown in the previously mentioned U.S. Pat. No. 4,153,326. This connector 84 includes a housing 90, a cover 92, and terminals 94. Each terminal has a mating portion 96, a slotted plate conductor engaging portion 98, and an intermediate locking lance 100. The conductors 102 of the secondary cable 14 are terminated by the respective terminals 94 and secured in the connector in the manner described in the above mentioned U.S. patent, the disclosure of which is incorporated herein by reference.

The tap of the primary cable 12 is effected by the subject device 10 in the following manner. First, the outer insulation jacket 104 of the primary cable 12 is slit and removed to expose the insulated conductors 72 and ground wire 106. The conductors and ground wire are laid in the cable passage 22 against the slotted plate portions 58 of the respective terminals 56. The cover member 20 is placed over the conductors with projections 108, 110 engaging the conductors on opposite sides of the respective slotted plates 58. The conductors are terminated by squeezing the cover member 20 and base member 18 together to drive the conductors into the respective slots 66. This motion also causes the lugs 38 of the base member to engage the respective apertures 42 of the latch portions 40 to hold the cover member in place. Screws 46 are applied to the front and rear bores 44 to effect a strain relief at the front end rear entrances of the primary cable passage 22. The secondary cable 14 is terminated with the known connector 84 and the tap is effected by merely joining the connector 84 to the mating face 26 the subject tap device 10. The assembly can then be fixed to the stud or the like by driving nails or screws (not shown) through the bores 32, 34.

The present invention may be subject to many modifications and changes without departing from the spirit or essential characteristics thereof. The present embodiment should therefore be considered in all respects as illustrative and not restrictive of the scope of the invention.

What is claimed is:

1. A power cable tap device for removably joining a secondary circuit to a primary cable run, said device comprising:

a housing of insulative material having a base member and a cover member, said base member and said cover member together defining therebetween a single power cable passage extending from one end of said housing to the other end and having offset parallel portions at the opposite ends thereof, a mating face on said base member adapted to receive a mating connector member terminating a tapping cable, at least two terminal passages in said base member intersecting said cable passage, extending parallel to at least a portion thereof and opening on said mating face;

at least two terminals each mounted in a respective terminal passage of said base member, each said terminal having a conductor engaging first end lying in said terminal passage directed toward said mating face;

whereby a power cable positioned in said cable passage is terminated by said terminals and a tap effected by engaging a mating connector member to said terminals at said mating face.

2. A power cable tap device according to claim 1 further comprising:

cable strain relief means at opposite ends of said cable passage, said strain relief means comprising a projection in one of said base and cover members extending transversely of said cable passage and an aligned recess in the other of said base and cover members, said projection and recess defining a tortuous path for said cable, and means to tightly secure said base and cover members together in the immediate region of said strain relief means.

3. A power cable tap device according to claim 1 further comprising:

means for fixedly securing said device to a rigid member.

4. A power cable tap device according to claim 1 further comprising:

means for detachably securing said cover member to said base member, said means including integral latching portions on one of said base and cover members and aligned mating latching lugs on the other of said base and cover members.

5. A power cable tap device according to claim 1 wherein said conductor engaging first end of each said terminal comprises:

a plate extending normal to the longitudinal axis of said terminal and defining therein a slot of such dimensions as to receive a conductor while stripping insulation surrounding said conductor, and means to support said plate during insertion of said conductor.

6. A power cable tap device according to claim 1 wherein said mating opposite end of each said terminal comprises:

a first blade portion and a second blade portion overlying said first blade portion, blade segments forming said second blade portion being connected by bights to marginal edges of said first blade portion and defining a slot therebetween, said first blade portion having a tine extending from the free end thereof for engaging in said slot of a mating terminal.

7. A power cable tap device according to claim 1 further comprising:

a locking lance on each said terminal adapted to secure said terminal in said base member.

8. A device for removably tapping a secondary circuit off a cable run comprising:

a housing of insulative material having a base member and a cover member, means to detachably secure said cover member to said base member, said base member and said cover member together defining therebetween a single through power cable passage extending from one end of said housing to the other end and having offset parallel portions at the opposite ends thereof, a mating face in said base member defining a receptacle for a mating connector, at least two terminal passages in said base member intersecting said cable passage and opening on said mating face, each of said terminal passages having a longitudinal axis extending parallel to at least part of said power cable passage, and means to fixedly secure said housing to a rigid support; and a plurality of terminals each mounted in a respective one of said terminal passages of said base member, each of said plurality of terminals having an insulation piercing, conductor engaging first end lying in said power cable passage and a mating opposite end lying in said terminal passage directed toward said mating face;

whereby a cable positioned in said cable passage is terminated by said first ends of said terminals and a tap effected by engaging said mating connector terminating an end of a tap cable to said mating face with the terminals of said mating connector engaging the mating ends of the terminals lying therein.

* * * * *